United States Patent [19]

Vail, Sr. et al.

[11] Patent Number: 4,705,178

[45] Date of Patent: Nov. 10, 1987

[54] WIRE CUBE FOR USE IN A MODULAR DISPLAY RACK

[76] Inventors: Kenneth E. Vail, Sr., 2560 Los Lomitas Way, Covina, Calif. 91724; Kenneth E. Vail, Jr., 758 Level Ave., Covina, Calif. 91723

[21] Appl. No.: 863,081

[22] Filed: May 14, 1986

[51] Int. Cl.[4] ..... A47F 3/14

[52] U.S. Cl. ..... 211/126; 211/194; 206/513; 220/23.83

[58] Field of Search ..... 211/126, 194, 181, 188, 211/133; 312/107; 220/23.6, 23.83; 206/513, 511

[56] References Cited

U.S. PATENT DOCUMENTS

| | | | |
|---|---|---|---|
| 2,529,267 | 11/1950 | Sloane | 211/181 X |
| 2,606,683 | 8/1952 | Rudd | 206/511 |
| 3,314,549 | 4/1967 | Goldreich et al. | 211/181 X |
| 3,653,734 | 4/1972 | Ungaro | 312/107 |
| 4,079,836 | 3/1978 | Von Stein et al. | 211/181 X |
| 4,508,230 | 4/1985 | Ashton | 211/194 X |
| 4,529,088 | 7/1985 | Quong | 220/23.6 X |

*Primary Examiner*—Robert W. Gibson, Jr.
*Assistant Examiner*—Blair M. Johnson
*Attorney, Agent, or Firm*—W. Edward Johansen

[57] ABSTRACT

The present invention is a wire cube which includes a pair of screens each of which is formed out of a steel grid in which steel wires are disposed on a rectangular member, which is formed out of steel wire, and arranged in cris-crossing vertical rows and horizontal columns. Each of the vertical rows is spaced apart a particular distance from each adjacent vertical row. The pair of screens are spaced apart. The wire cube also includes a plurality of rectangular spacing members which are formed out of steel wire. The plurality of rectangular spacing members are affixed to the pair of spaced-apart pair of screens. The plurality of spacing rectangular members are coaxially aligned with each other, but are off-set from the pair of spaced-apart screens in order to form a male end and female end so that at least two of the wire cubes may be joined together to form a modular display rack.

1 Claim, 4 Drawing Figures

WIRE CUBE FOR USE IN A MODULAR DISPLAY RACK

BACKGROUND OF THE INVENTION

1. Field of the Invention

The present invention relates to modular display racks for the displaying and selling of merchandise and more particularly to a plurality of wire cubes for use in assembling a modular display rack.

2. Description of the Prior Art

A great variety of different designs of display racks for merchandise have been proposed, which satisfy various objectives. Thus it is desirable both to display the merchandise attractively, and also to provide an actual point of sale, whereby the merchandise can be sold directly off the display, and thus incorporates its own storage capacity, and it is desirable also to incorporate some form of advertising display at such point of sale. In addition to all of those factors however which are more or less self-evident, in the past, have been achieved to a certain extent in a variety of different ways it also desirable that when setting up a new sales programme, the manufacturer or supplier shall be able to provide to the vendor or retailer a complete package consisting of an inventory of the merchandise itself, and also display racks particularly designed to both display and sell the product with the maximum of customer appeal.

U.S. Pat. No. 4,313,544, entitled Display Rack, issued to Richard D. A. Ashton on Feb. 2, 1982, teaches a display rack which has a back wall and at least two side walls and which has a plurality of hinge mechahnisms interconnecting between the respective side walls and the back wall. The hinge mechanisms are located at spaced apart intervals whereby the side walls may be swung flat against the back wall for shipping and may be swung away therefrom for erection. The shelving is dimensioned in order to fit between the two side walls when the same are swung apart and the shelving has fastener integral therewith interengageable with the side walls whereby the shelving may be secured along either side edge to respective side walls, in supporting relation thereto, and at the same time interlocking such side walls together in predetermined spaced apart relation so that they are no longer swingable with respect to the back wall, and forming a rigid three-dimensional structure.

U.S. Pat. No. 4,324,076, entitled Wall Units, issued to Rueben Honickman on April 13, 1982, teaches a closet structure which is installed in a building which has an alcove defined by first and second side walls and a back wall of the building. The closet is defined by wall units which are disposed on one of each of the side walls of the alcove with the back wall remaining exposed between the wall units. Each unit is in the form of a relatively rigid self-supporting panel which is formed with an array of openings for receiving article supporting elements engaged in the opening. Each panel is coupled to the relevant one of the side walls with the outer surface of the panels generally vertical and the inner surface spaced from the wall. The wall units may also be used in store for storing and displaying merchandise.

U.S. Pat. No. 4,344,367, entitled Modular Product Display System, issued to Milton J. Merl on Aug. 17, 1982, teaches a modular display system for beverage bottles which includes a base assembly and at least two spaced apart upright supporting webs detachably connected to the base assembly.

U.S. Pat. No. 4,351,244, entitled Shelving System issued to James A. Shuttles on Sept. 28, 1982, teaches a four-post merchandiser which includes two lightguage sheet metal corner posts which are reinforced against twisting by a dual camming action by which the two posts are urged tightly against the corners of the shelves.

U.S. Pat. No. 4,359,947, entitled Shelving Assembly, issued to Howard J. Marschak on Nov. 23, 1982, teaches a shelving assembly which is used for displaying or storing merchandise in commercial establishments in any of several ways which are tailored to meet the needs of that establishment. The components are capable of being combined to produce a shelving assembly with any selected number of either inclined or horizontal shelves.

U.S. Pat. No. 4,379,431, entitled Shelving Assembly, issued to John J. Clement on Apr. 12, 1983, teaches a shelving assembly which includes vertically disposed corner posts interconnected at their bottom ends by header panels. The shelving assembly is used for displaying or storing merchandise in commercial establishments.

U.S. Pat. No. 4,384,751, entitled Shelving Units and Their Use in Display Cabinets and Rearrangeable Shop Fitting, issued to Rita Cuntermann and Hermann Siekmann on May 24, 1983, teaches a shelving unit which includes a pair of ladder-like members each of which is formed from two vertical elements connected by a plurality of horizontal elements. Several interchangeable generally rectangular shelves rest upon respective opposed pairs of the horizontal elements.

U.S. Pat. No. 4,419,938, entitled Plug Assembled Sectional Display Rack, issued to Albin Kaut on Dec. 13, 1983, teaches a plug assembled multi-shelf sectional display rack which includes a plurality of horizontal and vertical hollow sections which are joined together at their ends by corner junctions which have vetically and horizontally extending plugs engageable within the hollows of the sections.

U.S. Pat. No. 4,430,947, entitled Shelf Support System, issued to Martin C. Kvame on Feb. 14, 1984, teaches a support system for shelving which includes a first female element which is attached to the side wall or other wall of a display stand and a second male element which is attached to the sides or ends of shelving whicn is provided for the display stand. The support system elements are designed so that they may be snapped together when the display stand is being assembled and slid apart when the display stand is being disassembled.

U.S. Pat. No. 4,444,322, entitled Display Rack, issued to Vernon E. Lee on Apr. 24, 1984, teaches a display rack for retail food merchandising which is assembled upon a novel adjustable frame structure. The display rack includes a pair of end structure assemblies and a pair of center structure assemblies, each of which includes a vertical support member attached to upper and lower horizontally extendible members. The center structure assemblies are placed between and perpendicular to the end structure assemblies which are positioned parallel to each other. Each center structure assembly is securably attachable to its adjacent end structure assemblies.

U.S. Pat. No. 4,450,775, entitled Merchandise Display Rack, issued to David A. Brendle on May 29, 1984, teaches a merchandise display rack which is constructed of prefabriated materials for use in displaying merchandise and/or printed materials in stores and malls. Modular construction permits tailoring the size of the merchandise display rack according to individual needs.

The inventors have filed on Jan. 22, 1985 an application, entitled Support Mount for Use in a Modular Display Rack, Ser. No. 693,652 which teaches a support mount for use in mechanically coupling a display assembly to a modular display rack having a screen and a support frame to which the screen is mechanically coupled. The screen is formed out of a steel grid in which steel wires are arranged in cris-crossing vertical rows and horizontal columns. Each of the vertical rows is spaced apart a particular distance from each adjacent vertical row. The support mount includes a rectangular plate having a first end and a second end with the distance between the first and second ends being slightly larger than the particular distance which the vertical rows are spaced apart. The first end of the rectangular plate is pivotally coupled to one of the horizontal rows of steel wire so that the second end of the rectangular plate extends past the adjacent horizontal row of steel wire in order to contact the adjacent horizontal row of steel wire thereby releaseably securing the rectangular plate in place. The rectangular plate is mechanically coupled to the display assembly.

SUMMARY OF THE INVENTION

In view of the foregoing factors and conditions which are characteristic of the prior art it is the primary object of the present invention to provide a plurality of wire cubes for use in assembling a modular display rack.

In accordance with the present invention an embodiment of a wire cube is described. The wire cube includes a pair of screens each of which is formed out of a steel grid in which steel wires are disposed on a rectangular member, which is formed out of steel wire, and arranged in cris-crossing vertical rows and horizontal columns. Each of the vertical rows is spaced apart a particular distance from each adjacent vertical row. The pair of screens are spaced apart. The wire cube also includes a plurality of rectangular spacing members which are formed out of steel wire. The plurality of rectangular spacing members are affixed to the pair of spaced-apart pair of screens. The plurality of spacing rectangular members are coaxially aligned with each other, but are off-set from the pair of spaced-apart screens in order to form a male end and female end so that at least two of the wire cubes may be joined together to form a modular display rack.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
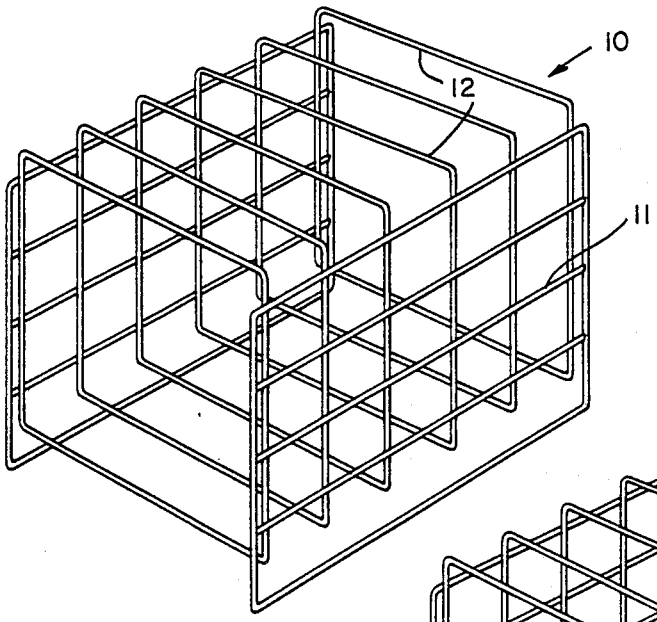
FIG. 1 is a perspective drawing of a first wire cube which has been made in accordance with the principles of the present invention and a plurality of which are used in assembling a modular display rack.

In order to best understand the present invention it is necessary to refer to the following description of its preferred embodiment in conjunction with the accompanying drawing. Referring to FIG. 1 a first wire cube 10 includes a pair of screens 11. Each screen 11 is formed put of a steel grid in which steel wires are disposed on a rectangular member, which is formed out of steel wire, and arranged in cris-crossing vertical rows and horizontal columns. Each of the vertical rows is spaced apart a particular distance from each adjacent vertical row. The pair of screens 11 are spaced apart. The first wire cube 10 also includes a plurality of rectangular spacing members 12 which are formed out of steel wire. The plurality of rectangular spacing members 12 are affixed to the pair of spaced-apart pair of screens 11.

Figure 2:
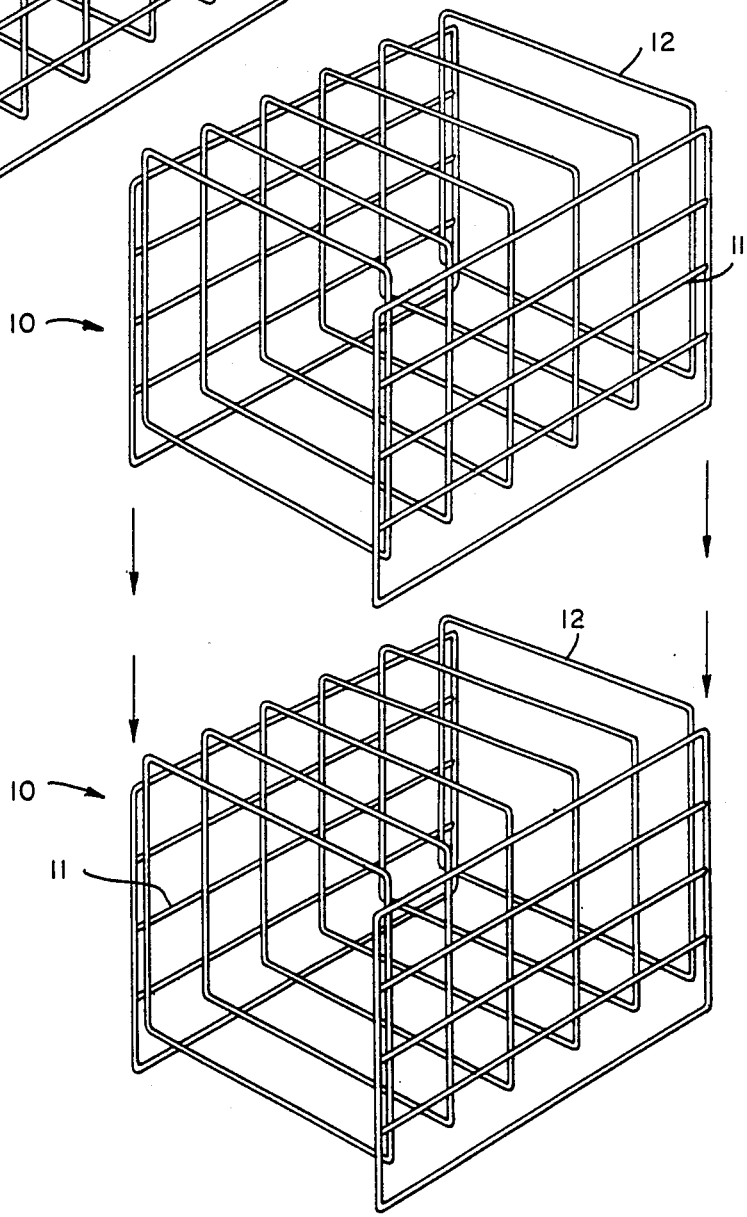
FIG. 2 is a perspective drawing of two of the first wire cubes of FIG. 1 which are shown with the female end of one of the first wire cube interconnecting the male end of another of the first wire cube.
Figure 3:
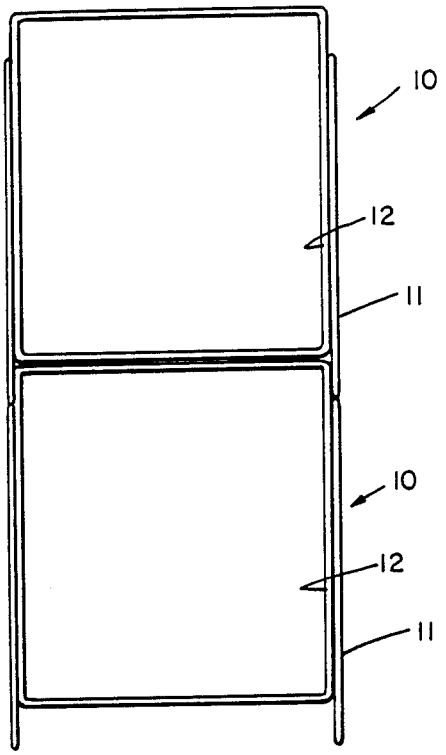
FIG. 3 is a side elevational view of the two first wire cubes of FIG. 1.

Referring to FIG. 2 in conjunction with FIG. 1 and FIG. 3 the plurality of spacing rectangular members 12 are coaxially aligned with each other, but are off-set from the pair of spaced-apart screens 11 in order to form a male end and female end so that at least two of the first wire cubes 10 may be joined together to form a modular display rack.

Figure 4:
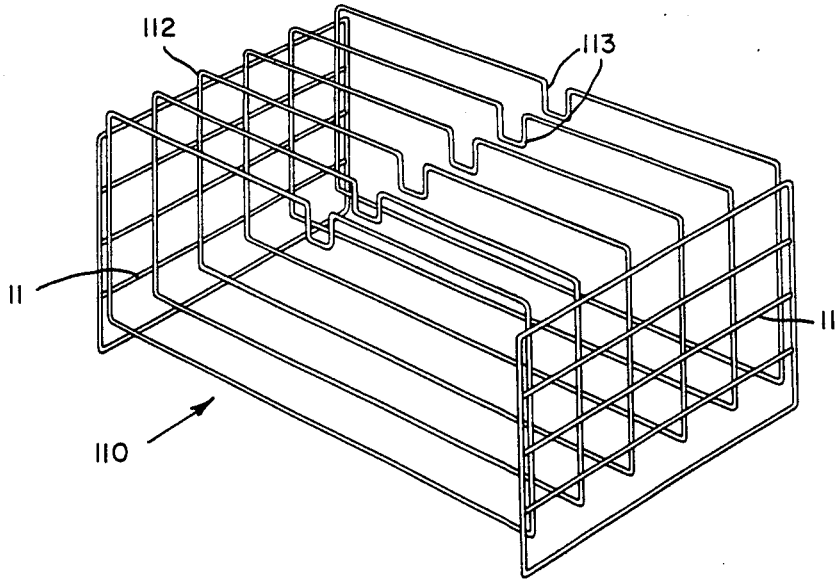
FIG. 4 is a perspective drawing of a second wire cube which has been made in accordance with the principles of the present invention and a plurality of whicn are used in assembling a modular display rack.

Referring to FIG. 4 a second wire cuoe 110 includes a pair of screens 11. Each screen 11 is formed out of a steel grid in which steel wires are disposed on a rectangular member, which is formed out of steel wire, and arranged in cris-crossing vertical rows and horizontal columns. Each of the vertical rows is spaced apart a particular distance from each adjacent vertical row. The pair of screens 11 are spaced apart. The second wire cube 110 also includes a plurality of rectangular spacing members 112 which are formed out of steel wire. The plurality of rectangular spacing members 112 are affixed to the pair of spaced-apart pair of screens 11. Each rectangular spacing member 112 has an indentation 113 which is able to receive the female end of the first wire cube 10.

From the foregoing it can be seen that a plurality of wire cubes for use in assembling a modular display rack has been described. It should be noted that the sketches are not drawn to scale and that distances of and between the figures are not to be considered significant.

Accordingly it is intended that the foregoing disclosure and showing made in the drawing shall be considered only as an illustration of the principles of the present invention.

What is claimed is:

1. A wire cube comprising:

a. a pair of screens each of which is formed out of a steel grid in which a plurality of steel wires are arranged both in vertical rows, each of which is spaced apart a particular distance from each adjacent vertical row, and in horizontal columns, each of which is spaced apart a particular distance from each adjacent horizontal column, wherein each of said vertical rows criss-crosses each of said horizontal columns, said steel grid being disposed on a rectangular member which is formed out of steel wire wherein said pair of screens are spaced apart; and b. a plurality of rectangular spacing members which are formed out of steel wire and are affixed to said pair of spaced-apart pair of screens wherein said plurality of rectangular spacing members are coaxially aligned with each other, but are off-set from said pair of spaced-apart screens in order to from a male end and female end so that at least two of said wire cubes may be joined together to form a modular display rack.

* * * * *